US010723597B2

(12) United States Patent
Mebus et al.

(10) Patent No.: US 10,723,597 B2
(45) Date of Patent: Jul. 28, 2020

(54) CRANE AND COUNTER BALLAST CARRIER PLATE

(71) Applicant: Liebherr-Werk Ehingen GmbH, Ehingen (DE)

(72) Inventors: Marc Mebus, Illerkrichberg (DE); Franz Oelberger, Senden (DE)

(73) Assignee: LIEBHERR-WERK EHINGEN GMBH, Amsteehingen (DE)

( * ) Notice: Subject to any disclaimer, the term of this patent is extended or adjusted under 35 U.S.C. 154(b) by 245 days.

(21) Appl. No.: 15/686,720

(22) Filed: Aug. 25, 2017

(65) Prior Publication Data

US 2018/0057323 A1 Mar. 1, 2018

(30) Foreign Application Priority Data

Aug. 26, 2016 (DE) ..... 10 2016 010 365

(51) Int. Cl.
*B66C 23/74* (2006.01)

(52) U.S. Cl.
CPC ..... *B66C 23/74* (2013.01)

(58) Field of Classification Search
CPC ..... B66C 23/36; B66C 23/74; B66C 23/72
See application file for complete search history.

(56) References Cited

U.S. PATENT DOCUMENTS 3,375,048 A * 3/1968 Korensky ..... B66C 23/74 212/178
3,822,791 A * 7/1974 Eiler ..... B66C 23/36 212/178
4,363,412 A * 12/1982 Patel ..... B66C 23/74 212/178
5,199,583 A * 4/1993 Weider ..... B66C 23/74 212/178
5,615,784 A 4/1997 Pech et al.

FOREIGN PATENT DOCUMENTS

DE 69321786 T2 3/1999

* cited by examiner

*Primary Examiner* — Sang K Kim
*Assistant Examiner* — Nathaniel L Adams
(74) *Attorney, Agent, or Firm* — McCoy Russell LLP

(57) ABSTRACT

The present disclosure relates to a mobile work machine, in particular to a crane or to a mobile crane, comprising an undercarriage, a superstructure rotatable with respect to the undercarriage, and a counter ballast carrier plate that can be mounted to the superstructure via a ballast suspension thereof, wherein the counter ballast carrier plate comprises at least one guide pin that can be guided along at least one guide edge of the undercarriage to bring the counter ballast carrier plate into a predefined installation position on the undercarriage.

8 Claims, 5 Drawing Sheets

CRANE AND COUNTER BALLAST CARRIER PLATE

CROSS REFERENCE TO RELATED APPLICATION

This application claims priority to German Patent Application No. 10 2016 010 365.5, entitled "CRANE AND COUNTER BALLAST CARRIER PLATE," filed Aug. 26, 2016, the entire contents of which is hereby incorporated by reference in its entirety for all purposes.

TECHNICAL FIELD

The present disclosure relates to a mobile work machine, in particular to a crane, or to a mobile crane, comprising an undercarriage, a superstructure rotatable with respect to the undercarriage, and a counter ballast carrier plate that can be installed at the superstructure via a ballast suspension thereof.

BACKGROUND AND SUMMARY

Mobile cranes require a counter ballast that can be installed at the superstructure. The counter ballast comprises a ballast carrier plate on which the required number of ballast plates can be stacked. To reduce the transport weight or the spatial dimension of the crane, the counter ballast, including the carrier plate, is removed from the superstructure of the crane for transport and is transported separately to the destination. At the destination, the counter ballast carrier plate can be installed at the superstructure by the crane itself or by means of an auxiliary crane. The counter ballast plate is first placed on the undercarriage of the crane for this purpose. It can be raised by means of the ballasting cylinders to the level of the installation points at the crane slewing platform of the superstructure and can be bolted there. However, the targeted placing of the ballast carrier plate on the undercarriage is a requirement for a smooth installation procedure.

Previous solutions provided one or more centering cones at the undercarriage that engage in corresponding recesses of the ballast carrier plate on a correct positioning. In addition, one or more metal abutment sheets were arranged at the undercarriage for a rough alignment of the counter ballast carrier plate.

It is, however, disadvantageous that the centering devices or abutments attached to the undercarriage construction may represent projecting edges during crane operation. This solution furthermore requires a large amount of complex welding work at the undercarriage.

It is therefore the object of the present disclosure to provide an improved and simpler solution for centering the counter ballast during the installation procedure.

Starting from the mobile work machine of the category, in particular a crane or mobile crane, a counter ballast carrier plate with one or more guide pins, with the latter being guidable along at least one guide edge of the undercarriage is provided. The counter ballast can be guided with the aid of the guide pins into a predefined installation position on the undercarriage by this mechanism during the unloading onto the undercarriage, for example by the crane itself or by any desired auxiliary crane, i.e. the counter ballast carrier plate is first raised to a height just above the undercarriage. In one embodiment, the ballast carrier plate may be raised to a height in the region behind the slewing platform, so that the guide pin or pins contact the at least one guide edge. In this position, the counter ballast carrier plate can be relocated, guided by the crane itself or by the auxiliary crane, into the predefined centered installation position. The ballast carrier plate is only completely placed onto the undercarriage on the reaching of the predefined installation position.

According to the present disclosure the ballasting may be done over the rear as a distinction from the prior ballast placement between the slewing ring center and the operator cabin.

The welding work at the undercarriage required in the prior art can be dispensed with by use of the one or more guide pins at the counter ballast carrier plate. Nor do any projecting edges arise at the undercarriage.

The arrangement of the at least one guide pin at a base plate of a ballasting cylinder of the counter ballast plate is particularly advantageous. If at least two guide pins are provided, they can be distributed over the base plates of the existing ballasting cylinders; ideally at least one guide pin is provided at a base plate per ballasting cylinder. In some embodiments, if an even number of guide pins are provided, they may be symmetrically arranged with respect to the longitudinal crane axis.

The at least one guide edge of the undercarriage may be formed by a matching push-in metal sheet of the undercarriage. A guide edge extending obliquely to the longitudinal axis of the crane has in particular proven advantageous. In one embodiment, in a configuration of the at least two guide edges for at least two guide pins, the guide edges may each run obliquely outwardly in the direction of the vehicle rear so that their spacing from one another increases toward the rear of the vehicle. In this case, the ballast carrier plate can first be guided along the guide edges until both guide pins contact their respective guide edge.

A movement of the counter ballast carrier plate transversely to the longitudinal direction of the crane can be blocked by the guide edge. Only degrees of freedom of the counter ballast carrier plate remain in a direction of the guide edge and in the vertical direction.

In another embodiment, the guide pin may be lockable in the predefined installation position. Once the installation position is reached, the ballast carrier plate may be completely placed on the undercarriage. The placing of the ballast plate may result in an automatic locking of the guide pin, in particular in that the latter engages into a recess of the undercarriage.

Only a vertical movement of the counter ballast carrier plate is enabled by this additional locking in the destination position; all other degrees of freedom are blocked. An accidental relocation of the counter ballast carrier plate may thereby be prevented. The vertical movement only allows a raising of the counter ballast carrier plate, in particular by means of the ballasting cylinders, into the installation position at the superstructure provided for this purpose.

In an additional embodiment, at least two guide edges at the undercarriage that run apart in the longitudinal or transverse crane direction and serve the guidance of two separate guide pins of the counter ballast carrier plate are provided.

In one embodiment, the at least one guide pin is movably supported in the vertical direction. The guide pin can, for example, be supported in a spring-loaded manner. A hydraulic and/or pneumatic actuation of the guide pine is also conceivable. The guide pin can furthermore be movable in the vertical direction by its own weight (gravitationally moveable). The movable support in the vertical direction provides that any damage to the undercarriage and/or to the guide pin can be avoided if the counter ballast carrier plate is placed incorrectly on the undercarriage. On too great a pressure load on the guide pin, the latter is, for example, displaced upwardly in the vertical direction. It is, for example, conceivable that the guide pin has a housing in which the guide pin may be vertically displaceably supported. On too great a pressure load on the guide pin, the latter moves into the housing.

In another embodiment, the at least one guide pin or the crane may be equipped with a visual and/or acoustic and/or electric display. This display possibility is intended to indicate an incorrect placement of the counter ballast carrier plate on the undercarriage to the crane operator. The display responds, for example, when the at least one guide pin is moved in the vertical direction and is in particular pushed partially or completely into the guide pin housing. Ideally, a corresponding visual display can be provided directly at the guide pin housing.

To compensate for any production tolerances or to finely adjust the desired centering position of the counter ballast carrier plate on the undercarriage, it is expedient if the at least one guide pin is adjustable in its position with respect to the counter ballast carrier plate by means of one or more setting means. A displaceable support transverse to its longitudinal axis is particularly preferred here. This is achieved, for example, by one or more metal adjustment sheets that can be actuated by means of screws and thus enable a displacement of the at least one guide pin or of the housing of the guide pin transversely to its longitudinal axis.

In addition to the crane in accordance with the invention, the present disclosure likewise comprises a counter ballast carrier plate having at least one guide pin for guiding the counter ballast carrier plate during the installation at a crane. The features of the counter ballast carrier plate may correspond to those features that have already been explained at the crane above with reference to the counter ballast carrier plate. This in particular relates to the movable support of the guide pin at the counter ballast carrier plate. To avoid repetition, a repeat description will be dispensed within the following.

Further advantages and properties of the present disclosure will be explained in more detail in the following with reference to an embodiment shown in the drawings.

DETAILED DESCRIPTION

Figure 1A:
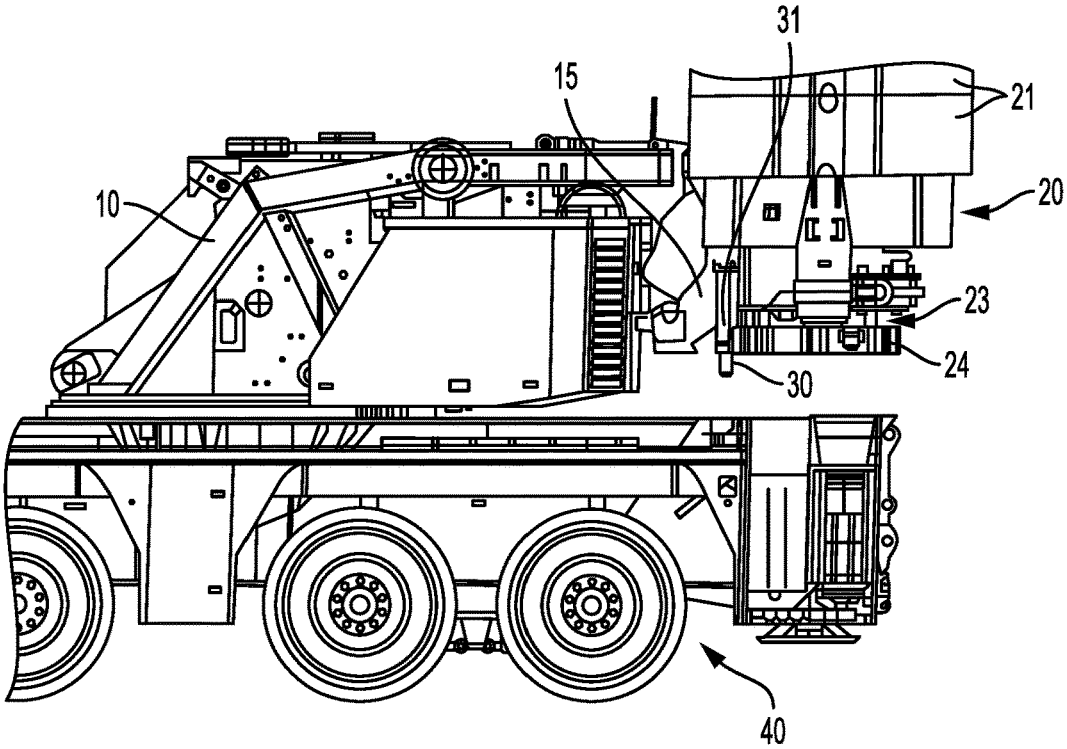
FIGS. 1A and 1B show side representations of the mobile crane in accordance with the invention.
Figure 1B:
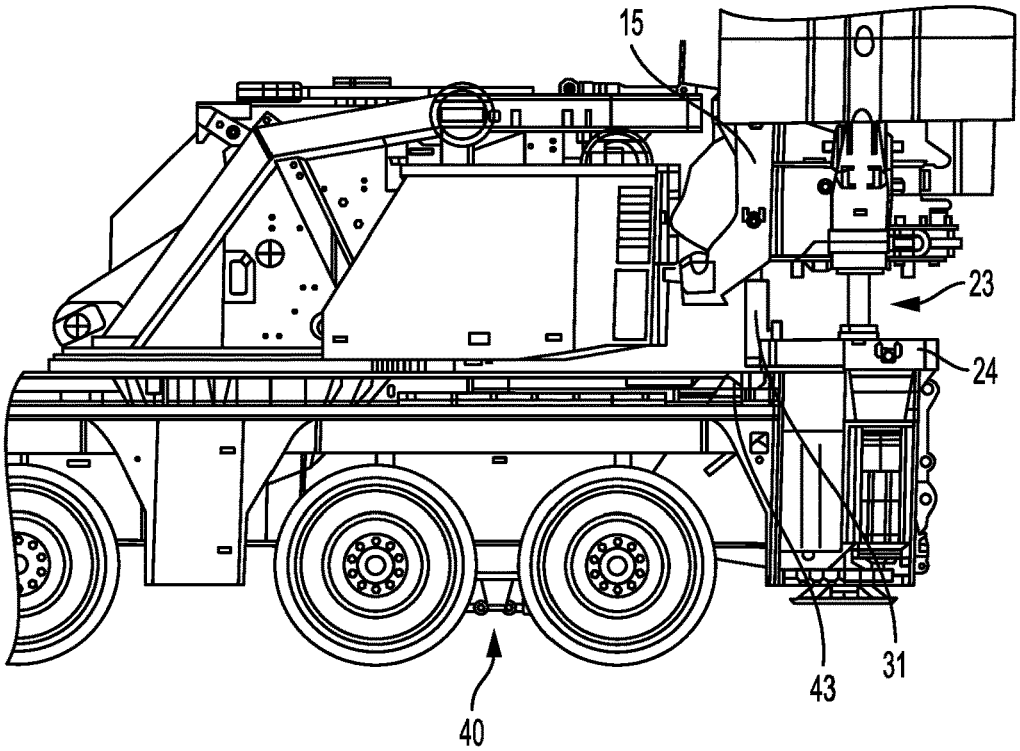
Figure 2:
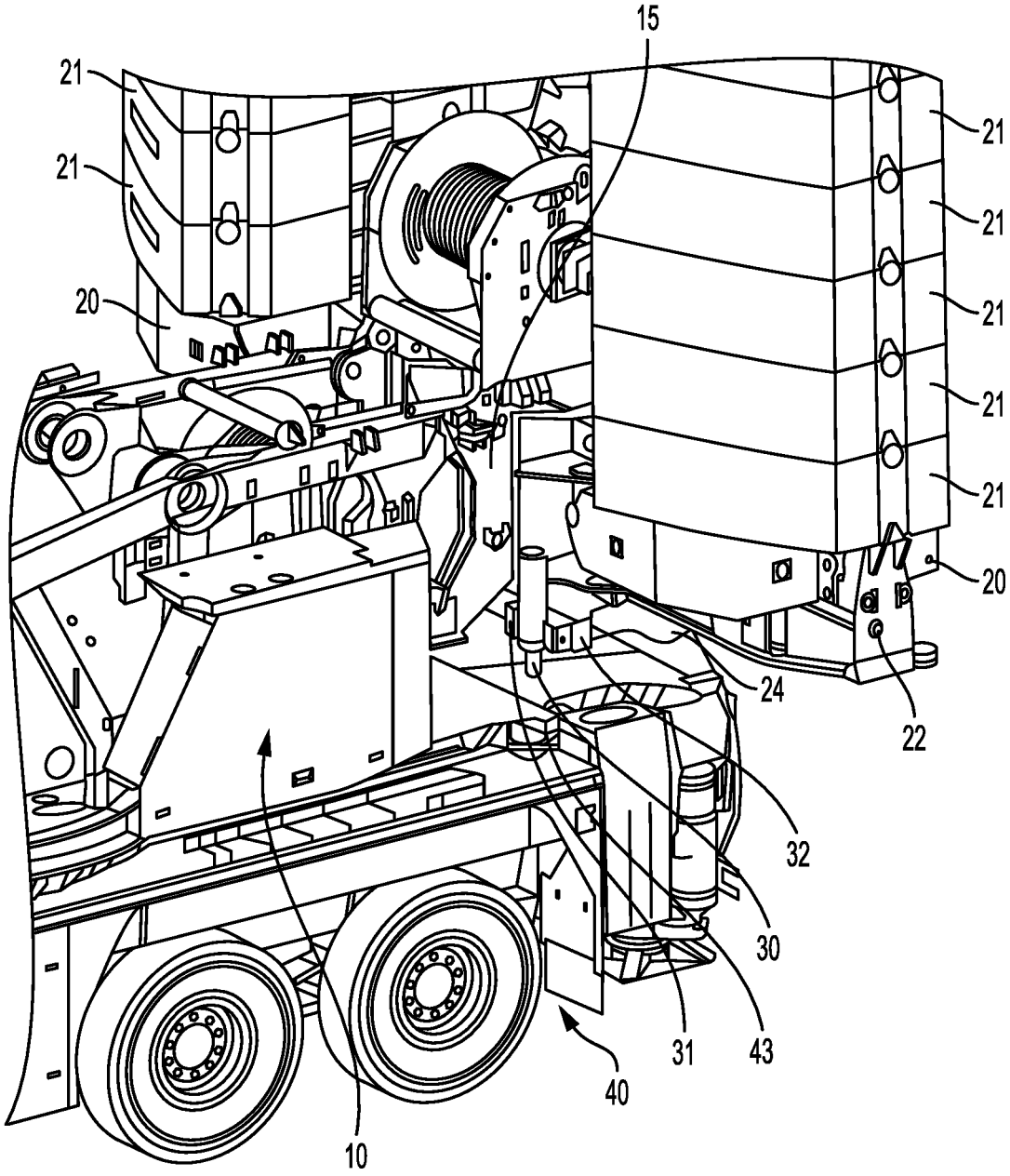
FIG. 2 shows a perspective side view of the mobile crane in accordance with the invention.

The side representations of FIGS. 1A and 1B illustrate the basic principle of the counter ballast carrier plate. In this respect, FIG. 1A shows the counter weight frame 15 installed at the crane slewing platform 10 of the superstructure with the ballast carrier plate 20. One or more ballast plates 21 are stacked on the ballast carrier plate 20. The counter weight frame 15 can have pivotable ballast arms 22 to vary the position of the received ballast plates 21 during crane operation and to operate the crane with different ballast radii.

This represents an optional configuration of the counter weight frame 15; the present disclosure is easily usable with non-variable ballast carrier plates.

The counter weight frame 15 further comprises two ballasting cylinders 23 to raise the counter weight frame 15 placed on the undercarriage 40 to the level of the crane slewing platform 10. The counter weight frame 15 can be bolted to the crane slewing platform 10 in this position. FIG. 1B shows the ballasting cylinders 23 with an extended piston rod, whereas the piston rod has been retracted into the cylinders in FIG. 1A. The ballasting cylinders 23 are connected to the counter weight frame 15 at their one end and to the base plate 24 at their other end. The base plate 24 serves the support of the counter weight frame 15 with respect to the undercarriage 40. It is a requirement for the problem-free bolting of the counter weight frame 15 to the crane slewing platform 10 that the counter weight frame 15 has previously been placed centered on the undercarriage 40 in a predefined installation position.

Figure 5:
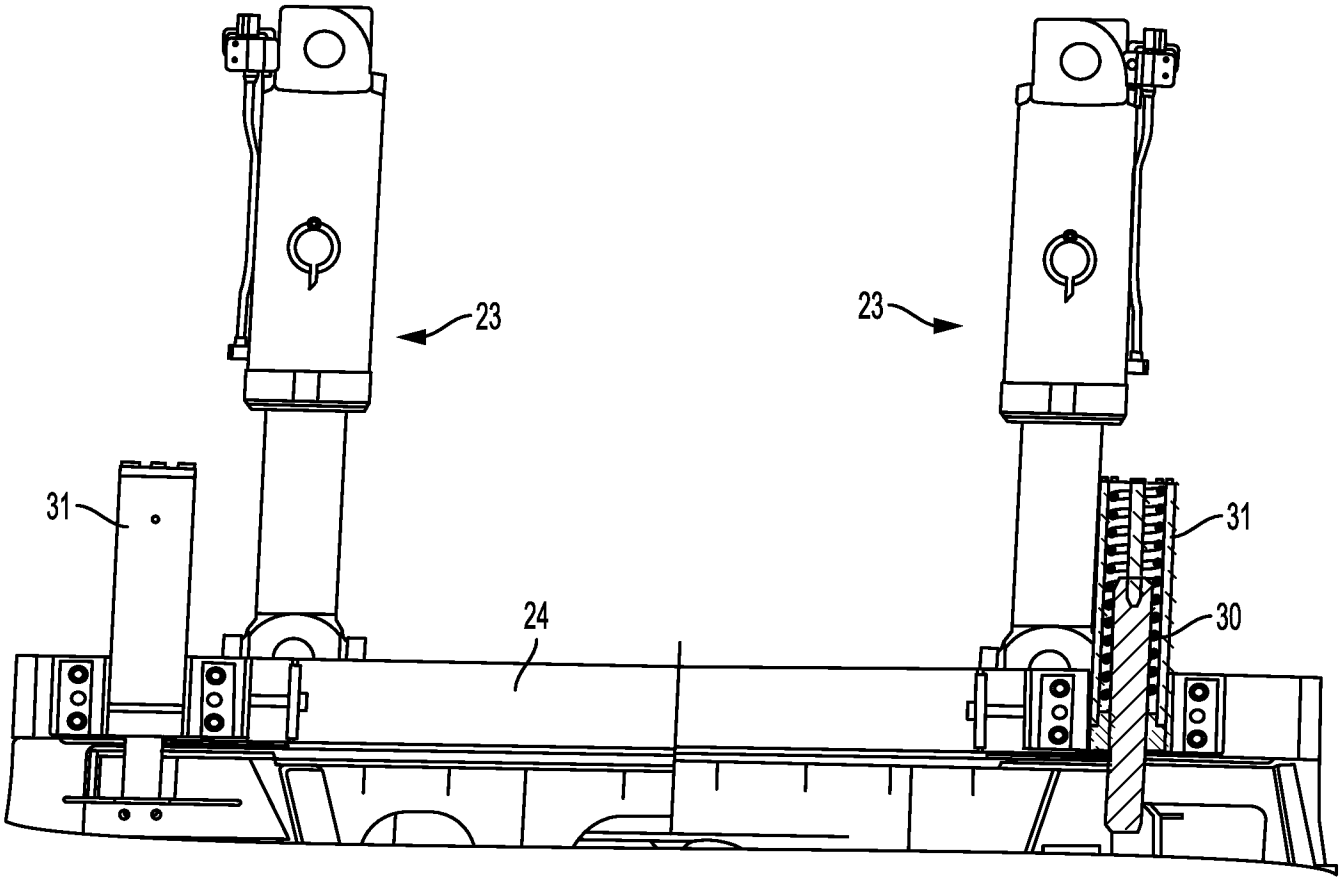
FIG. 5 shows a rear view of the mobile crane in accordance with the invention.

This may be achieved by the two guide pins 30 that in one embodiment are seated laterally offset with respect to the longitudinal crane axis at a respective base plate 24 of the ballasting cylinders 23. This can be easily recognized in the rear view of the crane in accordance with FIG. 5.

The guide pins 30 are displaceably supported in an axial or vertical direction in a cylinder housing 31. The cylinder housing 31 may be installed at the counter weight frame 15 or at its base plate 24 via the consoles 32.

Figure 3:
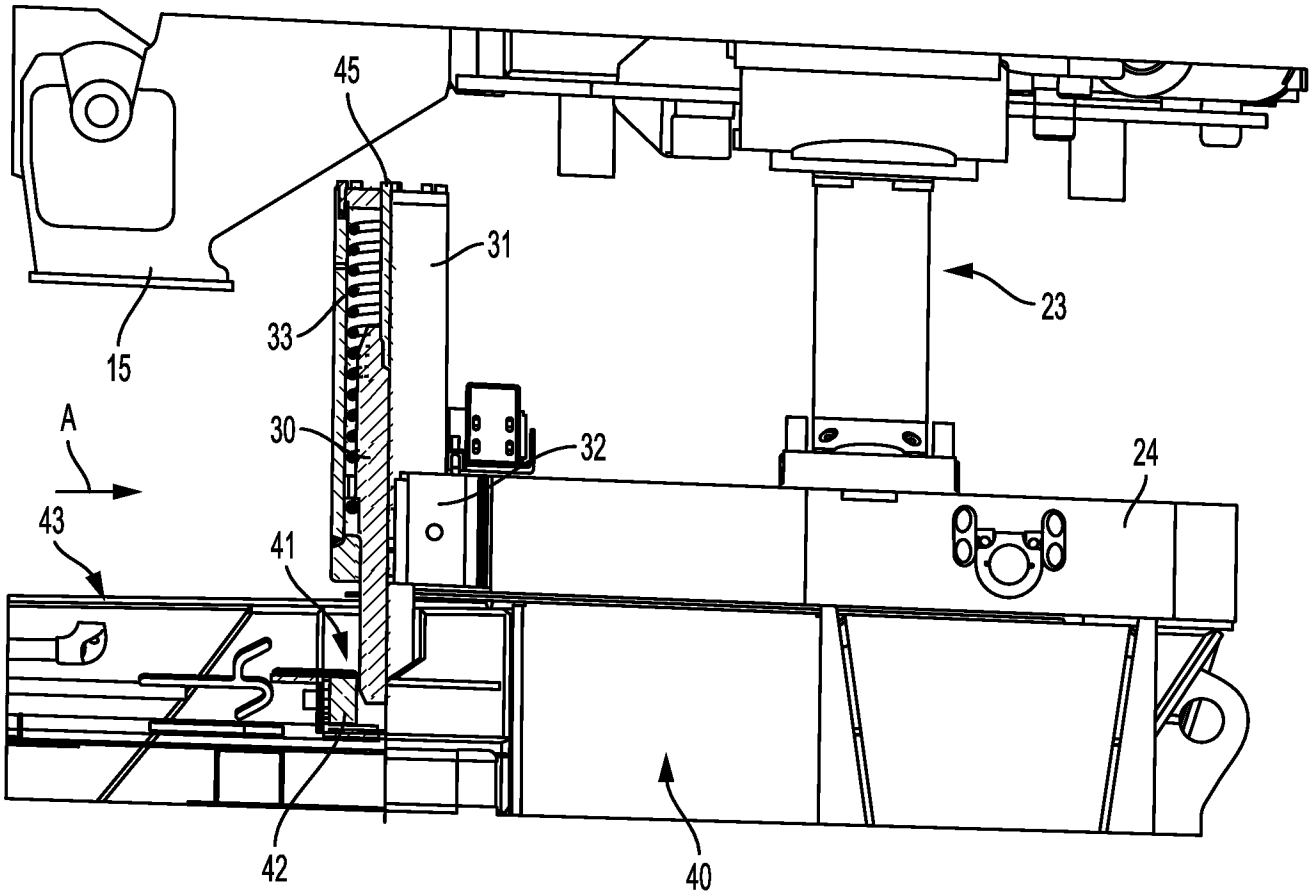
FIG. 3 shows a detailed representation of the counter ballast carrier plate in accordance with the present disclosure with a guide pin, partly sectioned.

The sectional representation of FIG. 3 shows the movable support of the guide pin 30 within the cylinder housing 31. In the embodiment shown, the guide pin may be supported by the spring element 33 in a spring-loaded manner such that said guide pin is pushed out of the cylinder housing 31 to the bottom due to the spring effect. On an improper pressure load on the guide pin 30, the latter is pushed into the cylinder housing 31 against the spring force. This is the case, for example, when the counter weight frame 15 is incorrectly positioned on the undercarriage 40 so that the guide pin cannot engage into a corresponding recess at the undercarriage 40.

FIG. 3 shows the ballast carrier plate in the predefined centered installation position on the undercarriage 40. The guide pin 30 may be locked in this respect since it projects into the separate recess 41 of the undercarriage 40. A movement of the guide pin 30 and thus of the counter weight frame 15 in the longitudinal crane direction is blocked by the abutment 42. A movement of the counter weight frame 15 may be restricted in the transverse direction by the guide edge 43. Consequently, only a vertical movement of the counter weight frame 15 is consequently possible in this position.

Figure 4:
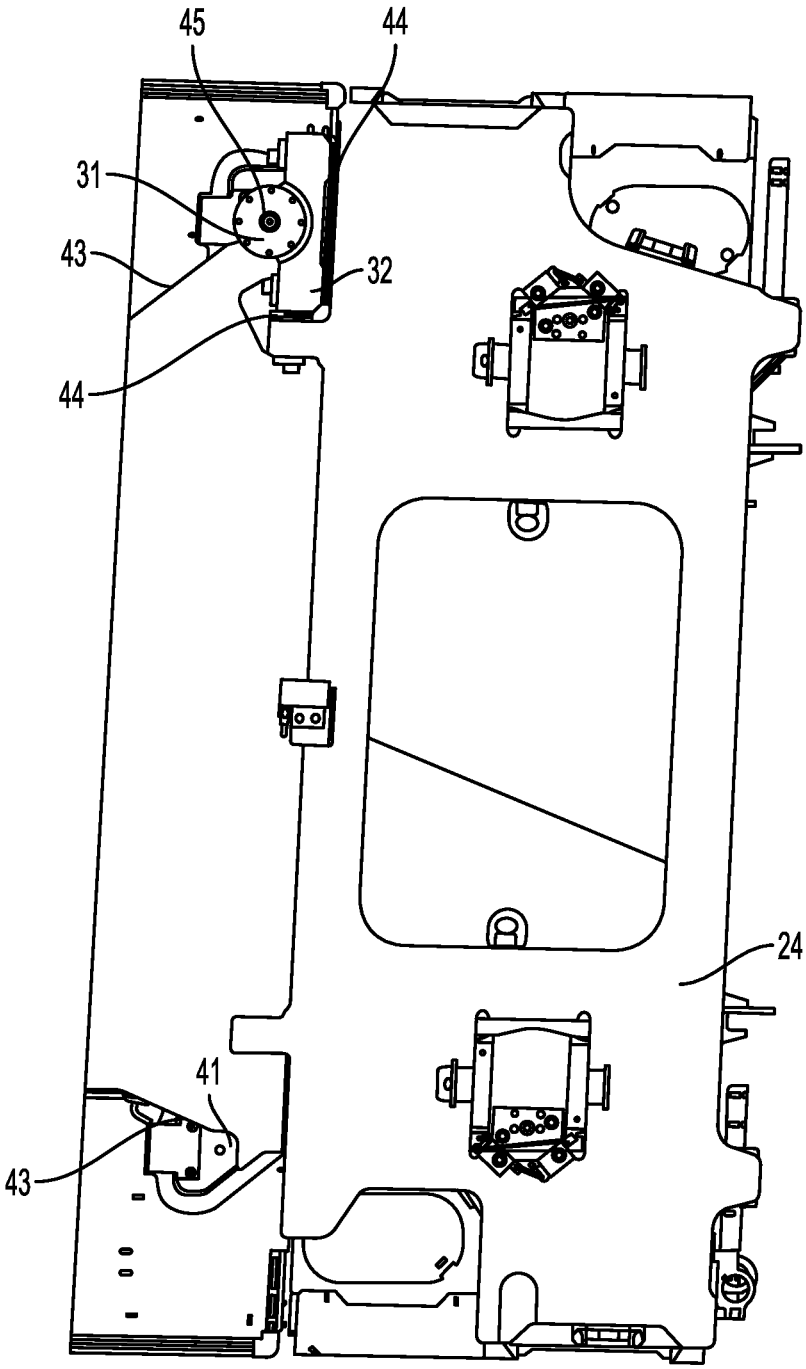
FIG. 4 shows a plan view of the undercarriage of the mobile crane.

To bring the counter weight frame 15 into the predefined installation position in which the guide pin 30 projects into the recess 41, matching guide edges 43 are provided at the undercarriage that will be explained in more detail in the following with reference to FIG. 4. The representation of FIG. 4 shows a plan view of the steel construction of the undercarriage 40. The base plate 24 placed on the undercarriage 40 can likewise be seen. Only a cylinder housing 31 is drawn in the drawing; it is not shown at the lower edge of the base plate 24 in the drawing plane to offer an unimpeded view of the guide edge 43 of the undercarriage 40 disposed thereunder.

It can additionally be recognized that the guide edges 43 form side edges of the undercarriage surface. In addition, both guide edges extend obliquely outward in the direction of the rear of the vehicle so that the spacing of both guide edges 43 increases toward the rear of the vehicle. A symmetry of the guide edge 43 is not absolutely necessary in this respect.

The counter weight frame 15 may be first held just above the undercarriage 40 for the ballast installation such that both guide pins 30 laterally contact their guide edges 43 or are positioned in the direct vicinity next to the guide edges. The counter weight frame 15 can now be moved in the direction of arrow A (see FIG. 3) toward the rear of the vehicle until both guide pins 30 contact their respective guide edges and are disposed above their associated cut-out 41 (see position in FIG. 3). A movement of the counter weight frame 15 taking place transversely to the longitudinal axis of the crane may be blocked by the obliquely outwardly extending guide edges 43 or the counter weight frame 15 may be centered centrally above the undercarriage 40 during the movement.

The counter weight frame 15 may be completely lowered onto the undercarriage 40 in this position, whereby the guide pins 30 engage into the cut-outs 41 and the counter weight frame 15 may additionally locked.

The arrangement of the guide pin housing 31 by means of a plurality of metal adjustment sheets 44 that allows an adjustment of the position of the guide pin 30 with respect to the base plate 24 of the ballasting cylinder 23 can likewise be seen in FIG. 4. Irregularities during the production of the crane can thereby be compensated and an exactly centered position of the counter weight frame 15 can be set. A visual display element 45 may be furthermore seated on the upper end face of the cylinder housing 31. If the guide pin 30 is partially or completely pushed into the cylinder housing 31, this is signaled to the crane operator via the display element 45.

FIG. 5 again shows a rear view of the mobile crane in accordance with the invention, wherein the left vehicle side is shown completely and the right vehicle side is reproduced in a sectional representation. The arrangement of the respective guide pins 30 offset as required with respect to one another and their engagement into the corresponding recesses 41 of the undercarriage 41 become clear from this Figure.

REFERENCE NUMERALS

Crane slewing platform 10
Counter weight frame 15
Ballast carrier plate 20
Ballast plates 21
Ballast arms 22
Ballasting cylinders 23
Base plate 24
Guide pins 30
Cylinder housing 31
Consoles 32
Spring element 33
Undercarriage 40
Recess 41
Guide edge 43
Metal adjustment sheets 44
Display element 45

The invention claimed is:

1. A mobile work machine comprising an undercarriage, a superstructure rotatable with respect to the undercarriage, and a counter ballast carrier plate that can be mounted to the superstructure via a suspension of the counter ballast carrier plate thereof, wherein the counter ballast carrier plate comprises at least one guide pin that can be guided along at least one guide edge of the undercarriage to bring the counter ballast carrier plate into a predefined installation position on the undercarriage, wherein the at least one guide edge of the undercarriage guides the counter ballast carrier plate in a longitudinal crane direction.

2. The mobile work machine in accordance with claim 1, wherein the at least one guide pin is arranged at a base plate or a ballast base plate of a ballasting cylinder.

3. The mobile work machine in accordance with claim 1, wherein the at least one guide pin is lockable in a destination position, wherein when the guide pin is locked, movement of the counter ballast carrier plate is limited to vertical movement.

4. The mobile work machine in accordance with claim 1, wherein at least two guide edges are provided at the undercarriage that run apart in the longitudinal crane direction or in a transverse crane direction and serve to guide two separate guide pins of the counter ballast carrier plate.

5. The mobile work machine in accordance with claim 1, wherein the at least one guide pin is movably supported in a vertical direction and is retractable and extensible in one or more of a spring-loaded, hydraulic, gravitational, pneumatic, or manual manner.

6. The mobile work machine in accordance with claim 5, wherein the at least one guide pin is lockable in at least one position.

7. The mobile work machine in accordance with claim 1, wherein one or more of a visual, acoustic, or electric display is provided that indicates an incorrect placement of the counter ballast carrier plate on the undercarriage to a crane operator and the display signals a defined vertical movement of the at least one guide pin.

8. The mobile work machine in accordance with claim 1, wherein the at least one guide pin is transversly adjustable to its longitudinal axis at the counter ballast carrier plate by means of a displaceable support.

* * * * *